United States Patent [19]

Nakamura et al.

[11] Patent Number: 4,825,066

[45] Date of Patent: Apr. 25, 1989

[54] PHOTOMULTIPLIER WITH SECONDARY ELECTRON SHIELDING MEANS

[75] Inventors: Kimitsugu Nakamura; Masuo Ito, both of Shizuoka, Japan

[73] Assignee: Hamamatsu Photonics Kabushiki Kaisha, Shizuoka, Japan

[21] Appl. No.: 155,842

[22] Filed: Feb. 12, 1988

[30] Foreign Application Priority Data

Feb. 13, 1987 [JP] Japan ..... 62-29659

[51] Int. Cl.[4] ..... H01J 40/14

[52] U.S. Cl. ..... 250/207; 313/533

[58] Field of Search ..... 250/207, 213 VT; 313/532, 533, 534, 535, 536

[56] References Cited

U.S. PATENT DOCUMENTS

| | | | |
|---|---|---|---|
| 2,895,068 | 7/1959 | Rodda | 250/207 |
| 3,109,957 | 11/1963 | McGee et al. | 313/536 |
| 3,391,295 | 7/1968 | Clayton | 250/207 |

FOREIGN PATENT DOCUMENTS

| | | |
|---|---|---|
| 504526 | 4/1939 | United Kingdom . |
| 595260 | 12/1947 | United Kingdom . |
| 975909 | 11/1964 | United Kingdom . |
| 1006688 | 10/1965 | United Kingdom . |
| 1014588 | 12/1965 | United Kingdom . |
| 1076853 | 7/1967 | United Kingdom . |
| 1115509 | 5/1968 | United Kingdom . |
| 1176910 | 1/1970 | United Kingdom . |

*Primary Examiner*—David C. Nelms
*Assistant Examiner*—Eric Chatmon
*Attorney, Agent, or Firm*—Finnegan, Henderson, Farabow, Garrett, & Dunner

[57] ABSTRACT

A photomultiplier for converting an incident weak light into multiplied electrons to thereby output an electrical signal corresponding to the intensity of the incidence light. The photomultiplier comprises a photocathode for emitting primary electrons; plural dynodes for emitting secondary electrons in response to incident of the primary electrons and multiplying first secondary electrons passing between the dynodes; and shield means for preventing second secondary electrons emitted from a first dynode of the dynodes toward the photocathode from returning to the dynodes, thereby to reduce the generation of a residual pulse currents caused by the second secondary electrons and to accurately detect a main pulse current caused by the first secondary electrons.

11 Claims, 11 Drawing Sheets

FIG. 5(A)
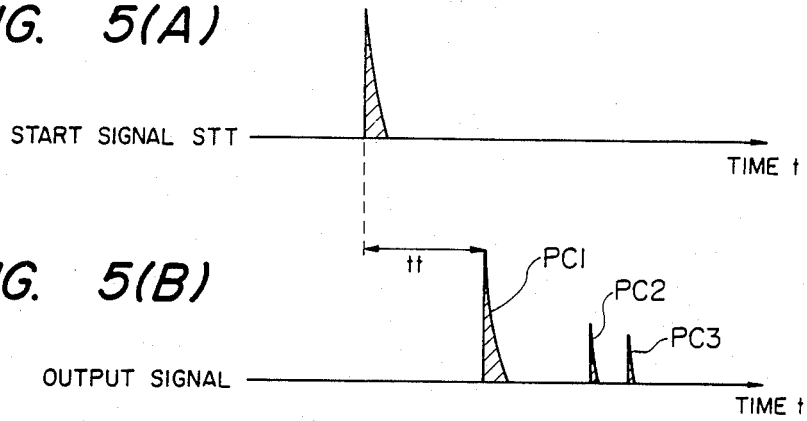
FIG. 5(B)
FIG. 6(A)
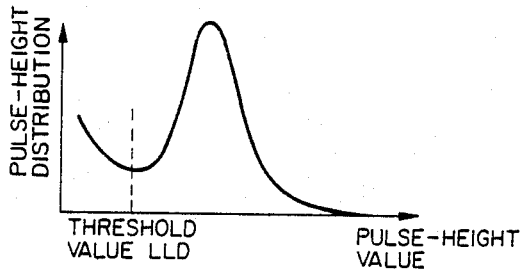
FIG. 6(B)
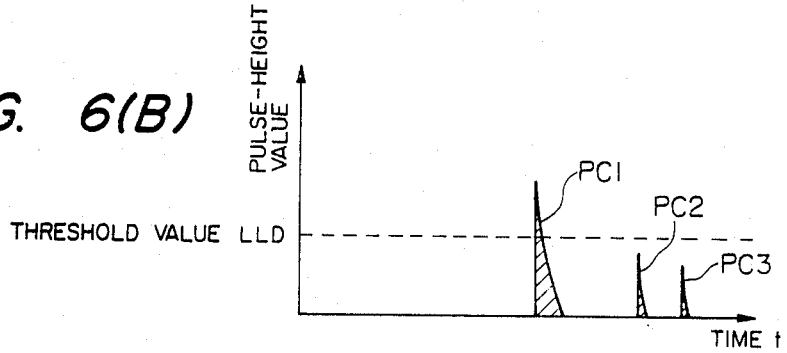

PHOTOMULTIPLIER WITH SECONDARY ELECTRON SHIELDING MEANS

BACKGROUND OF THE INVENTION

The present invention relates to photomultiplier for a fluorescent spectroscopic analyzer or the like based on a time-correlated single photon counting (SCP) or the like, and particularly relates to a photomultiplier in which weak light such as fluorescent light incident upon a photoelectron emission surface or a photocathode is converted into an electrical current corresponding to the intensity of the weak light.

In an ordinary photomultiplier, photoelectrons or primary electrons, which are emitted from the photocathode by light incident to the photocathode, are multiplied a large number of times by the secondary electron emission surfaces of plural dynodes so that an electrical current corresponding to the intensity the light is outputted from an anode.

FIG. 1 shows a sectional view of a conventional head-on-type photomultiplier 51 comprising the photocathode 4, a first focusing electrode 52, a second focusing electrode 53, a flat plate electrode 6, a first dynode 7 to a twelfth dynode 18 having secondary electron emission surfaces, an anode 19 and a cylindrical housing 2 containing the foregoing components therein. One end of the housing 2 is closed by a transparent light incident plate 3 and the other end of the housing is closed by a stem and covered with a plastic cap 20. The inside surface of the light-incident plate 3 is slightly curved at a radius of curvature, which is 55 mm or the like. The photocathode is curved along the inside surface of the light-incident plate 3 and made of a conventional photoelectron emission material such as a bialkali compound having a composition of K-Sb-Cs and a compound having a composition of Na-K-Sb-Cs (the S number is 20). The dynodes 7 to 18 are made of a nickel material. The inside surfaces of the dynodes are provided with the secondary electron emission surfaces made of an alkali antimonide having a composition of K-Cb-Cs, and are coated with a film of SbCs. The secondary electron emission surfaces of the dynodes are not shown in FIG. 1 except that of the first dynode 7. The first and the second focusing electrodes 52 and 53 are cylindrically shaped, and are provided between the photocathode 4 and the first dynode 7 so that photoelectrons or primary electrons emitted from the photocathode are converged to the first dynode. The tops of the first and the second focusing electrodes 52 and 53 are open. The central portion of the bottom of the first focusing electrode 52 has an opening 54 in which the second focusing electrode 53 is inserted. The central portion of the bottom of the second focusing electrode 53 has an opening 55 through which the primary electrons pass. The flat plate electrode 6 supports the first and the second focusing electrodes 52 and 53 so as to electrically separate the photocathode 4 from the dynodes 7 to 18 and the anode 19, and has a center opening 24 through which the primary electrons pass. The openings 54, 55 and 24 of the first and the second focusing electrodes 52 and 53 and the flat plate electrode 6 are concentrically provided to the housing 2. The photocathode 4, the first focusing electrode 52, the second focusing electrode 53, the flat plate electrode 6, the dynodes 7 to 18 and the anode 19 are connected to corresponding connection pins K, G, G1, DY1 to DY12 and P through stem pins and lead wires which are not shown in FIG. 1.

FIG. 2 shows the state of connection of the connection pins K, G, DY1 to DY12 and P of the photomultiplier 51 and an external circuit 37 which has sockets S14, S15, S1 to S13 corresponding to the connection pins. The socket S14 is connected to a power supply (which is not shown in the drawings) for applying a voltage (−H V). The sockets S15, S1 to S12 are connected to the power supply through bleeder resistors R1 to R16 and capacitors C1 to C9. One terminal of the bleeder resistor R16 is grounded. The capacitors C1 to C9 connected parallely with the bleeder resistors R10 to R16 are provided to keep the sockets S7 to S12 at predetermined potentials. The socket S13 is connected to a coaxial cable CBL. Since the external circuit 37 is used for detecting weak light, the number of incident photons of which is so small that the photons can be detected separately from each other, the socket S13 for taking out an output signal from the photomultiplier 51 is connected to the coaxial cable CBL through which the output pulse signal can be accurately transmitted.

When the photomultiplier 51 is connected to the external circuit 37, the photocathode 4 of the photomultiplier is kept at the lowest potential of −H V (e.g., −2,500 V) through the pin K. At that time, the potentials on the first focusing electrode 52 and the dynodes 7 to 18 are kept sequentially higher than the lowest potential on the photocathode 4, through the pins G, DY1 to DY12. The anode 19 is kept at the ground potential through the pin P, and the second focusing electrode 53 is kept at the same potential as the seventh dynode 13 through the pin G1.

A time-correlated single photon counting (SPC) is often used for a fluorescent spectroscopic analyzer or the like so as to measure weak short-lived fluorescent light or the like. In the fluorescent spectroscopic analyzer, an exciting light pulse EX having a sufficiently small width as shown in FIG. 3(A) is irradiated upon a sample such as a living body substance and a semiconductor to transit the molecules of the sample from the ground state to an excited state depending on the energy of the exciting light pulse. After that, the excited molecules go back to the ground state from the excited state to emit fluorescent light having a wavelength corresponding to an energy gap between the excited state and the ground state. In the time-correlated single photon counting, the intensity of the exciting light pulse EX is preset at a reduced level so that only single photon SP of the fluorescent light is detected within an observation time, whereby the single photon SP is emitted at a time point $t_2$ as shown in FIG. 3(C) after the sample is excited by the exciting light pulse EX at a time point $t_1$ as shown in FIG. 3(A). The probability of the emission of the single photon SP reaches a maximum when a very short time has elapsed since the time point $t_1$ at which the molecules are excited by the exciting light pulse EX. The probability decreases nearly exponentially with the lapse of time from the maximum. In the time-correlated single photon counting, the exciting light pulse EX is repeatedly irradiated upon the sample to repeatedly emit the single photon SP as shown in FIG. 3(C), thereby to determine the frequency $\alpha$ of the single photon with respect to the time of the emission thereof and obtain a fluorescent light damping curve $CV_o(t)$ indicating the time characteristic of the fluorescent light as shown in FIG. 3(B).

FIG. 4 shows a schematic view of an apparatus for measuring the weak light such as fluorescent light using the time-correlated single photon counting. In this apparatus, the time of the emission of the single photon does not fluctuate in accordance with the probability but is predetermined, so that when the measurement of the output signal from the photomultiplier of the apparatus is repeated by repeating irradiation of the single photon upon the photomultiplier, there would ideally appear a distribution in which a frequency corresponding to the number of the repetition is present only at a certain time point, in place of the fluorescent light damping curve.

FIG. 5(A) shows a start signal STT applied to a time-to-amplitude converter (TAC) 60 shown in FIG. 4, and FIG. 5(B) shows the output signal from the photomultiplier 51. FIG. 6(A) is a diagram for explaining a theshold value for the output signal from the photomultiplier 51, and FIG. 6(B) is a diagram for explaining a procedure of detecting only a light pulse current out of the output signal from the photomultiplier 51 based on the threshold value as determined in FIG. 6(A).

In the measuring apparatus shown in FIG. 4, the fluorescent light from the actual sample is not used but the weak light corresponding to the fluorescent light, which is generated by a pulse generator 62, an optical fiber 63 and a filter 64, is used. Therefore, the time of the emission of the single photon SP does not fluctuate in accordance with the probability thereof, but is predetermined. The apparatus is controlled by a computer 58 which is connected to a multichannel analyzer (MCA) 59. The time-to-amplitude converter 60 is connected to the multichannel analyzer 59. Time-to-amplitude converter 60 is supplied with the start signal STT as shown in FIG. 5(A) and measures the time difference between the generation of the start signal STT and that of a stop signal STOP as described hereinafter. If two output signals, that is, two pulse currents are outputted from the photomultiplier 51 and then two stop signals STOP are outputted from a constant-fraction discriminator (CFD) 66 per start signal STT, the time-to-amplitude converter 60 measures only the time difference between the generation of the start signal and that of the prior stop signal, disregarding the posterior stop signal. A delay circuit 61 applies the start signal STT to the time-to-amplitude converter 60 after a predetermined delay time it lapsed from a time at which the light is emitted from the pulse generator 62. For example, the delay circuit 61 is set so that the predetermined time is about 200 nanoseconds.

The pulse generator 62 includes a light emission diode (not shown in the drawings) for emitting light of 410 nanometers in wavelength. The light emitted from the light emission diode is guided to the filter 64 through the optical fiber 63. Before the light is entered into the photomultiplier 51, the filter 64 decreases the quantity of the light to create such a state (which is hereinafter called the SPE state) of single photoelectron event that only the photon can be detected in the photomultiplier 51 within the observation time. As a result, the single photon SP is irradiated upon the photomultiplier 51 after the lapse of the predetermined time from the time at which the light is generated by the pulse generator 62.

As mentioned above, the predetermined potentials are applied to the electrodes of the photomultiplier 51 from the external circuit 37 so that the photoelectrons or primary electrons are emitted from the photocathode 4 by the weak light incident upon the photomultiplier. The primary electrons emitted from the photocathode 4 are converged by the first and the second focusing electrodes 52 and 53 and reach the first dynode 7 through the opening 55 of the second focusing electrode and the opening 24 of the flat plate electrode 6. Secondary electrons are emitted from the secondary electron emission surface 22 of the first dynode according to the incident primary electrons to the first dynode. The secondary electrons reach the secondary electron emission surfaces (which are not shown in the drawings) of the second dynode 8 to the twelfth dynode 18 so that multiplication is performed through each secondary electron emission surface. As a result, the output signal is outputted in the form of an electrical current from the anode 19 to the external circuit 37.

Since the light incident upon the photocathode 4 is so weak as to create the SPE state, the output signal from the anode 19 consists of pulse currents PC1, PC2 and PC3 as shown in FIG. 5(B). The pulse current PC1 is a main pulse current and outputted from the photomultiplier 51 after a lapse of a time which it takes for the electrons to transit in the photomultiplier from the time of the irradiation of the single photon SP upon the photocathode 4.

The light-incident plate 3 of the photomultiplier 51 is covered with a black tape or the like except the 10-mm-diameter circle area of the plate to which a light is actually incident, in order to prevent the light from reaching an area of the photocathode 4 except the 10-mm-diameter circle area thereof.

The output signal, that is, the pulse current which is outputted from the external circuit 37, is amplified by an amplifier 65 and then supplied to the constant-fraction discriminator 66. The constant fraction discriminator 66 outputs only the pulse current larger than a predetemined threshold value LLD among the pulse currents from the amplifier 65. The LLD is set at a pulse-height at which the distribution of pulse-heights is minimum as shown in FIG. 6(A), and therefore the other pulse currents PC2 and PC3 are removed as noises caused by the dark currents of the photomultiplier 51. Accordingly, only the pulse current PC1 whose height is larger than the threshold value LLD is detected as a light pulse current.

When the light pulse current whose height is larger than the threshold value LLD is detected as mentioned above, the constant fraction discriminator 66 outputs the stop signal STOP to the time-to-amplitude converter 60 so that the converter does not accept the other following light pulse currents. The start signal STT from the pulse generator 62 is inputted to the time-to-amplitude converter 60 through the delay circuit 61 prior to an input of the stop signal STOP to the converter 60. The time-to-amplitude converter 60 recognizes in response to the stop signal STOP supplied from the constant-fraction discriminator 66 that the first light pulse current is generated for a start signal STT. The converter 60 measures the time tt which lapses from the generation of the start signal STT to that of the stop signal STOP.

Since the start signal STT is inputted to the time-to-amplitude converter 60 from the pulse generator 62 at a certain time and the stop signal STOP must ideally be outputted from the pulse generator after the lapse of a prescribed time from the time of the generation of the light from the pulse generator, the time tt must be constant. However, the time tt fluctuates because the orbits of the primary and the secondary electrons in the photomultiplier 51 are irregular.

When the time tt from the generation of the start signal STT to that of the stop signal STOP is measured by the time-to-amplitude converter 60, the result of the measurement is sent as a piece of measurement data to the multichannel analyzer 59 and the frequency $\alpha$ of the single photon for the time tt is increased by one in the computer 58.

FIG. 7 shows photon counting data obtained by repeatedly (100,000 times, for example) irradiating the single photon SP upon the photomultiplier 51 and supplying a plotter 57 with the photon frequency for the time tt from the generation of the start signal STT to that of the stop signal STOP. In FIG. 7, the time point tt of the highest photon frequency is shown as 0 nanosecond.

If the orbits of the primary and the secondary electrons in the photomultiplier 51 were not irregular, repeatedly mesured photon counting data should be detected as an ideal pulse current IP having a generation frequency corresponding to the number of the times of the repetition, only at a time point of 0 nanosecond as shown in FIG. 7. However, the orbits of the primary and the secondary electrons in the photomultiplier 51 are irregular, so that a main pulse current $MP_1$ having a time fluctuation of full width at half-maximum FWHM1 as shown in FIG. 7 and a residual pulse current $AP_1$ generated shortly after the generation of the main pulse current are practically detected. According to the conventional photomultiplier 51, it is understood from the photon counting data as shown in FIG. 7 that the full width at half-maximum FWHM1 of the single photon frequency corresponding to the main pulse current $MP_1$ is in the range of 500 to 600 picoseconds and the residual pulse current $AP_1$ is detected with a generation probability of 3 to 4% after about 15 to 20 nanoseconds from the detection of the main pulse current. The generation probability of the residual pulse current $AP_1$ is calculated as the ratio of the total frequencies AR2 of single photon for the residual pulse current $AP_1$ to those AR1 of single photon for the main pulse current $MP_1$.

The distributions of the frequencies of single photons SP for the main and the residual pulse currents $MP_1$ and $AP_1$ as shown in FIG. 7 are the results of the detection of the pulse currents which is performed in a case where the time of the generation of the single photon SP is predetermined and therefore is not fluctuated. In the actual measurement of the fluorescent light, however, the single photon SP is incident to the photomultiplier 51 according to the time characteristic as shown in FIG. 3(B), that is, the fluorescent light damping curve $CV_o(t)$, so that the temporal change in the single photon frequency actually detected by the photomultiplier 51 can be predicted in accordance with the following time convolution CV(t) of the time characteristic or damping curve $CV_o(t')$ of the actual fluorescent light and the time fluctuation curve g(t'-t) of the main and the residual pulse currents $MP_1$ and $AP_1$.

$$CV(t)=\int CVo(t')\cdot g(t'-t)dt'$$

The time convolution is calculated by the computer 58 and simultaneously outputted as fluorescent light damping data $CV_1(t)$ as shown in FIG. 7 to the plotter 47.

According to the conventional photomultiplier 51 shown in FIG. 1, the main pulse current MP1 has the time fluctuation of the full width at half-maximum FWHM1 which is in the range of about 500 to 600 picoseconds, and the residual pulse current $AP_1$ is outputted with the generation probability of 3 to 4% and measured in addition to the main pulse current.

The residual pulse current $AP_1$ has been recently thought to be generated due to the light feedback in which light emitted from the first dynode 7 proceeds to the photocathode 4 and returns to the first dynode. The present inventor et al have found out the rule that the time from the generation of the main pulse current $MP_1$ to that of the residual pulse current $AP_1$ is twice s long as the transit time of the primary electrons from the photocathode 4 to the first dynode 7. Since the transit time of the light from the photocathode 4 to the first dynode 7 in the light feedback is several hundred picoseconds which are much shorter than the transit time of the electrons, the above-mentioned rule could not exist if the residual pulse current $AP_1$ were generated due to the light feedback. Paying attention to the fact that the time from the generation of the main pulse current $MP_1$ to that of the residual pulse current $AP_1$ is twice as long as the transit time of the primary electrons from the photocathode 4 to the first dynode 7, the present inventor et al have discovered that the residual pulse current is not generated due to the light feedback but generated due to the phenomenon that the secondary electrons emitted from the secondary electron emission surface 22 of the first dynode 7 proceed to the photocathode and returns to the first dynode as indicated by orbits G1, G2, G3, G4 and G5 as shown in FIG. 1.

FIG. 8 shows the distribution of energy of the secondary electrons which are emitted from the secondary electron emission surface 22 of the first dynode 7 when the primary electrons with the energy of 100 eV impinge on the secondary electron emission surface. It is apparent from FIG. 8 that the distribution of energy of the secondary electrons can be classified into three regions a, b and c. In the region a, the secondary electron is emitted with the energy of about 2 eV. In the region c, the secondary electron is emitted with slightly less energy than the primary electron. In the region a, the secondary electrons are ordinary secondary electrons newly emitted from the secondary electron emission surface 22. In the region b, some of the secondary electrons are newly-emitted ordinary secondary electrons and the others are primary electrons which have impinged on the secondary electorn emission surface 22 with a loss of a part of energy in the process of exchanging energy on the surface and thereafter has been nonelastically reflected from the surface. The secondary electrons which are the primary electrons nonelastically reflected from the secondary electron emission surface 22 as described above are called backscattered electrons. In the region c, the secondary electrons are primary electrons which have lost a very small quantity of energy on the secondary electron emission surface 22 and therefore has been nearly elastically reflected from the surface. The electrons which are nearly elastically reflected from the surface 22 as described above are called elastically reflected electrons.

The secondary electrons in the region a of the distribution of energy correspond to the main pulse current $MP_1$ generated as shown in FIG. 9(A). The secondary electrons in the region b of the distribution of energy correspond to a main pulse current $MP_1'$ and a residual pulse current $AP_1'$ generated in a very short time after the main pulse current $MP_1'$ as shown in FIG. 9(B). In other words, the secondary electrons which are emitted as the ordinary secondary electrons in the region b of the distribution of energy and correspond to the main pulse current $MP_1'$, and the secondary electrons which are in the region b of the distribution of energy and emitted as the backscattered electrons correspond to the residual pulse current $AP_1'$. Since the backscattered electrons do not reach the photocathode 4, but change their directions and then returns to the first dynode 7, the residual pulse current $AP_1'$ corresponding to the backscattered electrons is generated in the very short time after the generation of the main pulse current $MP_1'$. However, the time-to-amplitude converter 60 of the apparatus measures only the time from the generation of the start signal STT to that of the stop signal STOP based on the first output signal, that is, the main pulse current $MP_1'$, and therefore the residual pulse current $AP_1'$ based on the backscattered electrons is not practically measured. The secondary electrons which are in the region c of the distribution of energy and are the elastically reflected electrons correspond to the residual pulse current $AP_1$ as shown in FIG. 9(C). The elastically reflected electrons are emitted from the first dynode 7 with slightly less energy than that of the electrons incident upon the first dynode, so that the elastically refected electrons proceed to the vicinity of the photocathode 4 as indicated by the orbits G1 to G5 as shown in FIG. 7, change their directions in that vicinity and return to the first dynode. Accordingly, a pulse current based on the elastically reflected electrons is outputted from the anode 19 with a time lag which is nearly twice as long as the transit time of the electrons from the photocathode 4 to the first dynode 7 and the pulse current is measured as the residual pulse current $AP_1$ as shown in FIG. 7. Since the elastically reflected electrons entail no main pulse current $MP_1$, the time tt up to the generation of the stop signal STOP based on the residual pulse current $AP_1$ is practically measured by the time-to-amplitude converter 60 of the measuring device.

The orbits G1 to G5 of the elastically reflected electrons are calculated through computerized simulation. It is assumed in the calculation that a distribution of the emitting angles of the elastically reflected electrons from the first dynode 7 depends on the incident angles of the primary electrons from the photocathode 4 to the first dynode 7 and that the elastically reflected electron is reflected in the same direction as the incidence of the primary electron with high probability.

FIG. 10 shows the distribution of the emitting angles of the elastically reflected electrons from the first dynode 7. It is apparent from FIG. 10 that the distributions $AD_0$, $AD_1$ and $AD_2$ of the emitting angles of the elastically reflected electrons corresponding to the primary electrons impinging on the first dynode 7 at incident angles $\theta$ of 0°, 30° and 45° have their main directions at angles $\theta$ of 0°, 30° and 45°.

The residual pulse current $AP_1$ generated and measured as described above causes the accuracy of the analysis of photon counting data based on the main pulse current $MD_1$ to be reduced and the calculation of the time convolution of the actual fluorescent light damping curve $CV_o(t)$ in FIG. 3(B) affords the fluorescent light damping data $CV_1(t)$ shown in FIG. 7. Therefore, the actual fluorescent light damping curve $CV_o(t)$ cannot be accurately predicted and it is preferable to remove the residual pulse current $AP_1$.

However, the elastically reflected electrons proceeding to the vicinity of the photocathode 4 return to the first dynode 7 with no obstacle to transit, and further the elastically reflected electrons are generated without being affected by materials of the secondary electron emission surface 22 of the first dynode 7 in the conventional photomultiplier 51, so that the photomultiplier has a problem that it is difficult to effectively suppress the generation of the residual pulse current $AP_1$.

SUMMARY OF THE INVENTION

It is therefore an object of the present invention to provide a photomultiplier in which the generation of a residual pulse current is effectively suppressed to enhance the accuracy of analysis of photon counting data of weak light such as fluorescent light based on a main pulse current.

In order to attain the above object, the photomultiplier according to the present invention comprises a photoelectric conversion means for emitting primary electrons; a focusing means for converging the primary electrons emitted from the photoelectric conversion means; electro-multiplication means for receiving the primary electrons from the photoelectric conversion means and emitting secondary electrons tberefrom; and shield means having at least one opening and disposed between the photoelectoric conversion means and the electro-multiplication means so that the primary electrons emitted from the photoelectric conversion means pass through the opening toward the electro-multiplication means and the secondary electrons emitted from the electro-multiplication means toward the photoelectric conversion means are captured.

When the weak light such as fluorescent light is irradiated upon the photoelectric conversion means of the photomultiplier according to the present invention, the primary electrons, that is, photoelectrons are emitted from the photoelectric conversion means. The primary electrons are converged by the focusing means, pass through the opening of the shield means and impinge on the electro-multiplication means. When the primary electrons impinge on the electro-multiplication means, the secondary electrons are emitted from the electro-multiplication means. Among the secondary electrons, those which are elastically reflected from the electro-multiplication means proceeds to the vicinity of the photoelectric conversion means and return to the electro-multiplication. The secondary electrons, which are the primary electrons elastically reflected from the electro-multipication means and cause the residual pulse current to be detected by an apparatus to reduce the accuracy of analysis of the photon counting data, are captured through reflection and absorption by the shield means provided between the photoelectric conversion means and the electro-multiplication means. Therefore, the probability that the secondary electrons elastically reflected from the electro-multiplication means impinge on the electro-multiplication means again can be decreased.

BRIEF DESCRIPTION OF THE INVENTION

Figure 1:
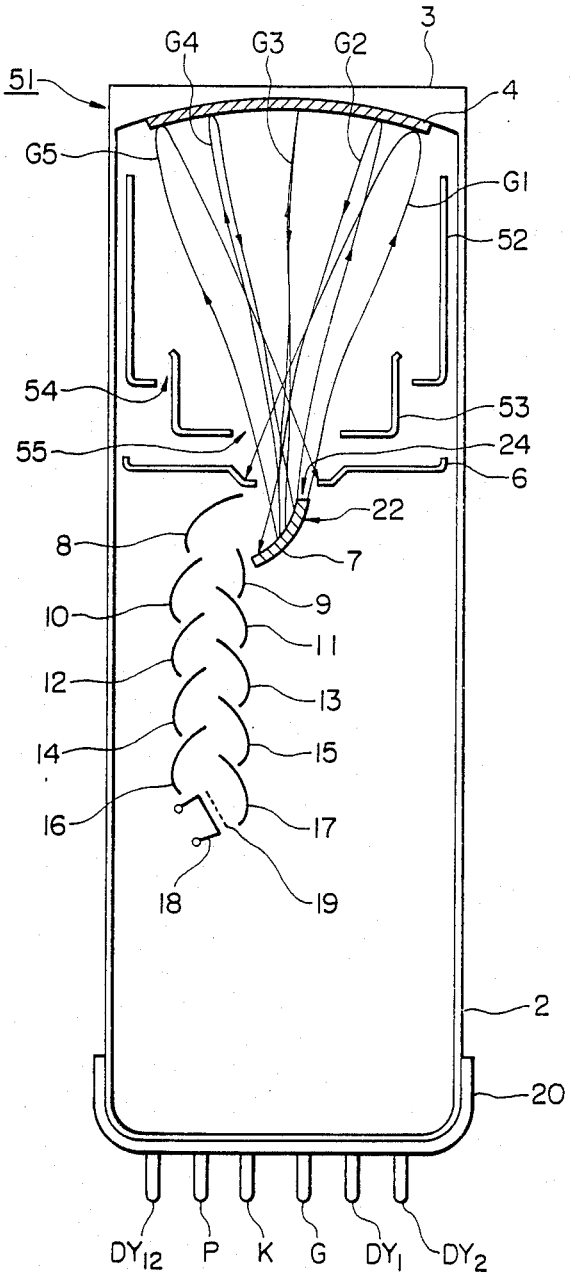
FIG. 1 shows a schematic view of a conventional photomultiplier.
Figure 3A:
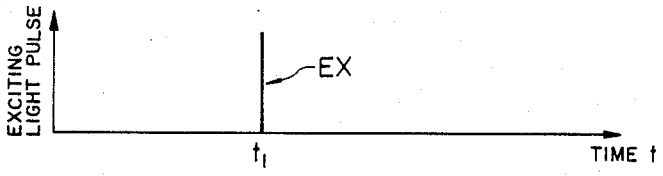
Figure 3B:
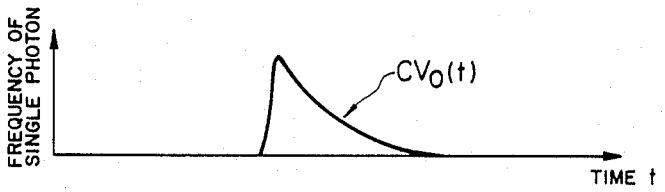
Figure 3C:
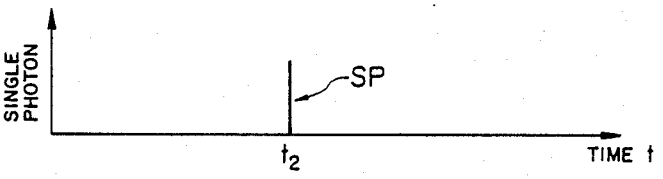
Figure 4:
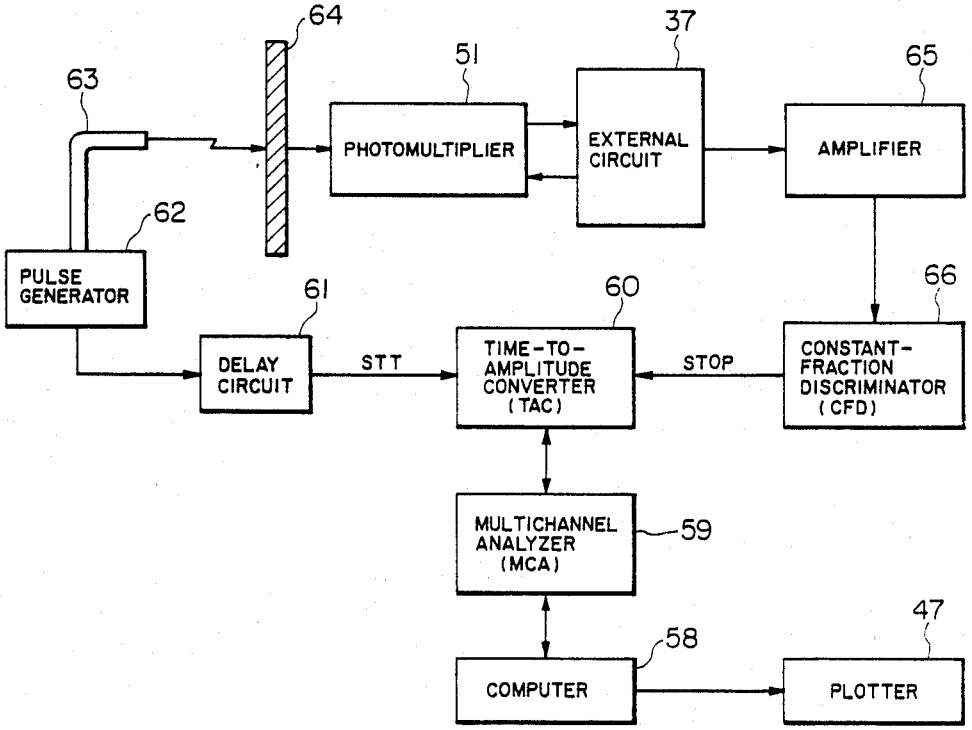
Figure 7:
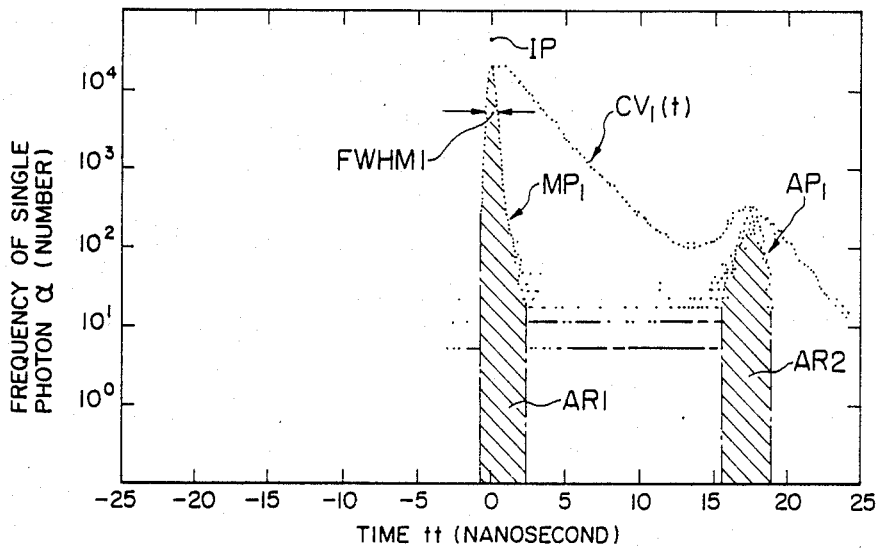
Figure 8:
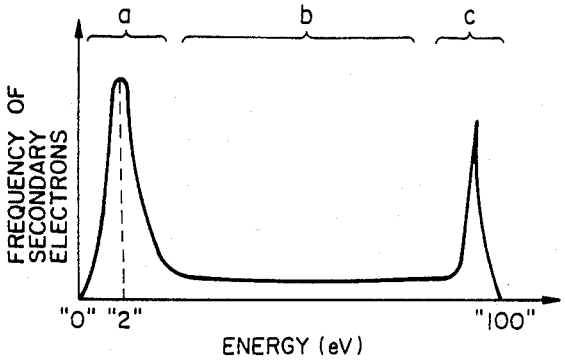
Figure 9A:
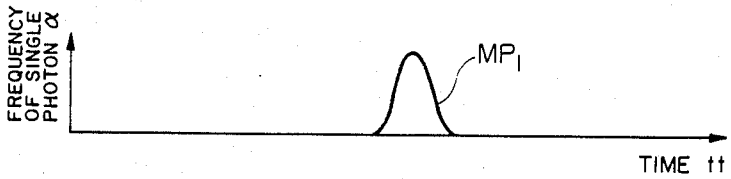
Figure 9B:
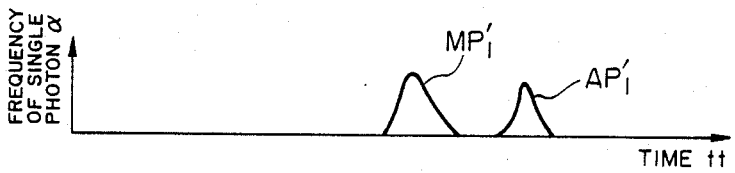
Figure 9C:
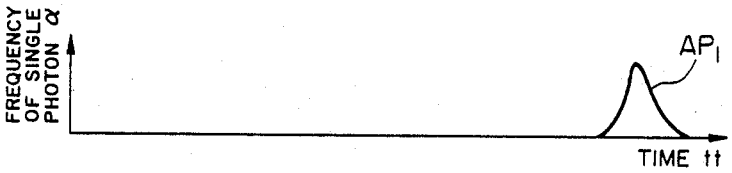
Figure 10:
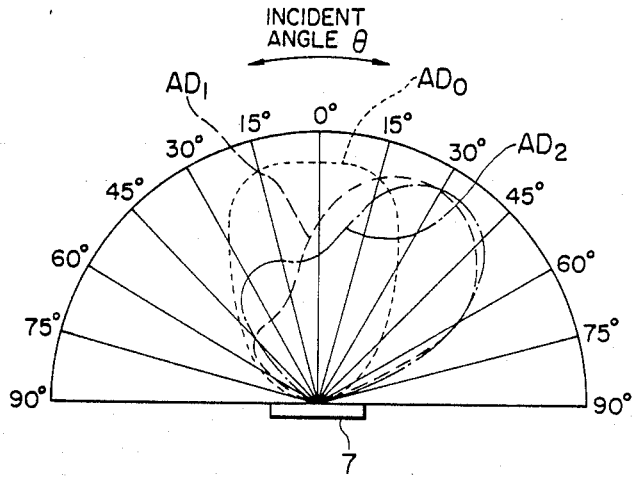
Figure 11:
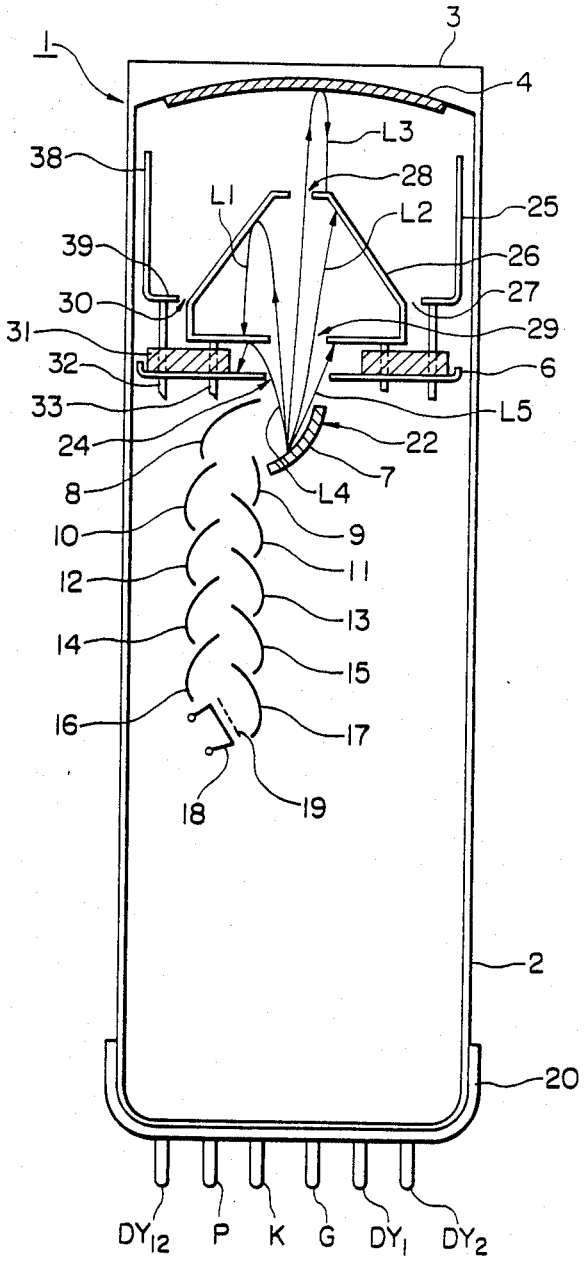
Figure 12B:
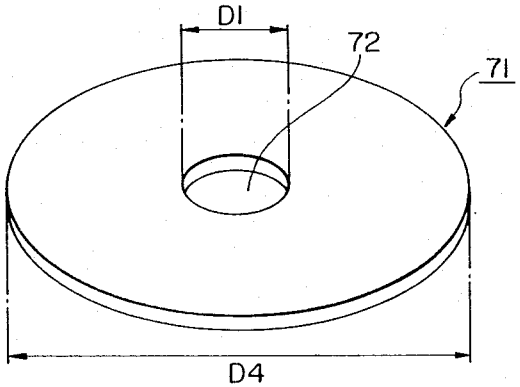
Figure 12C:
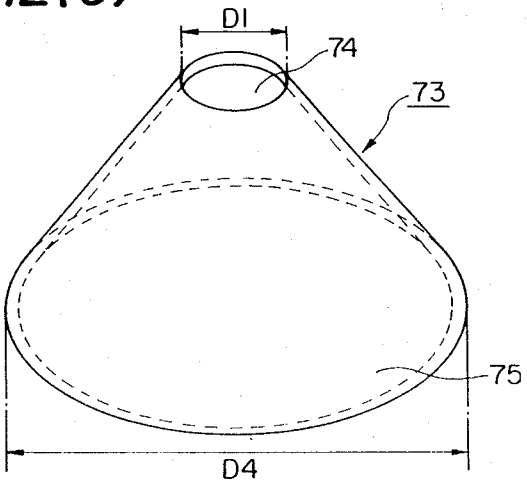
Figure 12A:
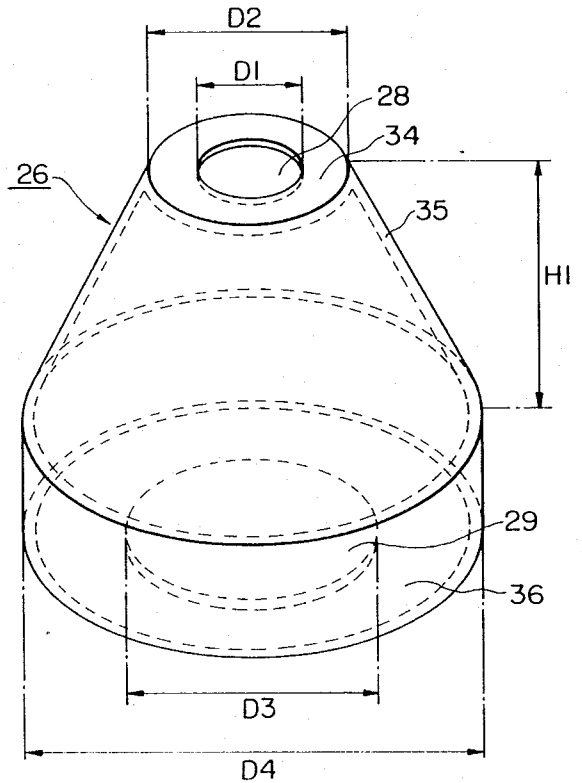
Figure 13:
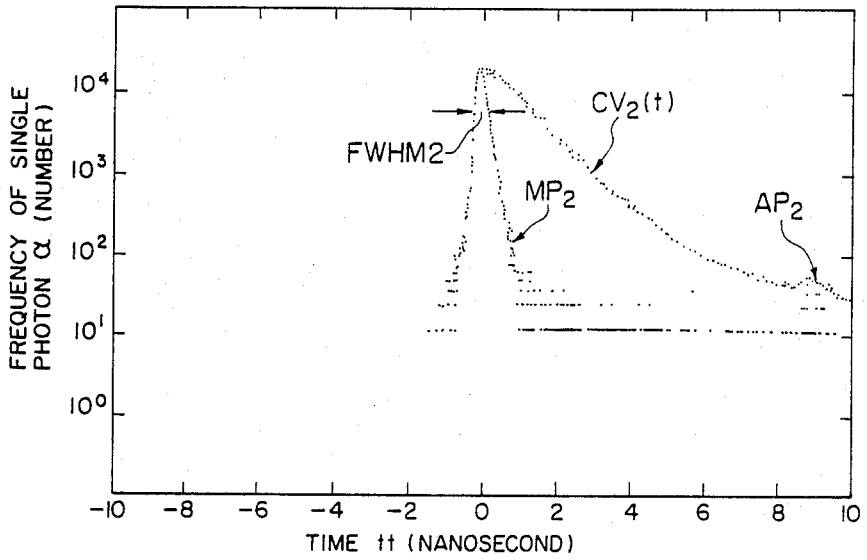
Figure 14:
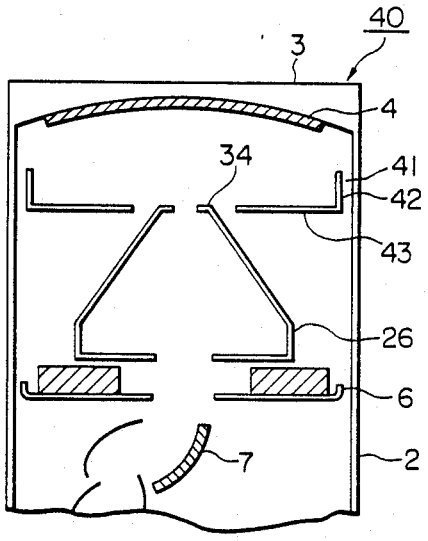
Figure 15:
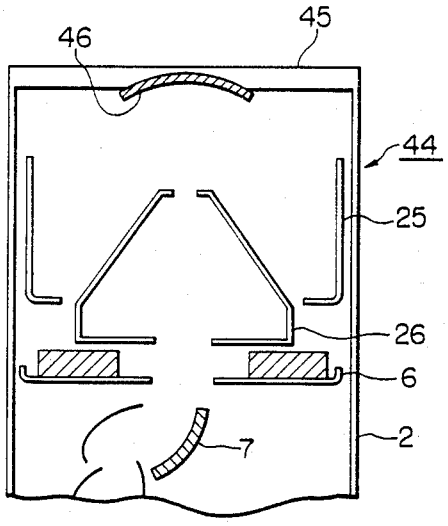

FIGS. 3(A), 3(B) and 3(C) are explanatory diagrams showing the generation of actual fluorescent light from a sample, FIG. 3(A) showing an exciting light pulse on the sample, FIG. 3(B) showing a fluorescent light damping curve and FIG. 3(C) showing the fluorescent light generated from the sample;

FIG. 4 shows a schematic view of a measuring device for obtaining photon counting data;

FIG. 5(A) shows a start signal in the apparatus as shown in FIG. 4 and FIG. 5(B) shows the output signal from the photomultiplier;

FIGS. 6(A) and 6(B) are explanatory diagrams for describing the setting of a threshold value for the output signal from the photomultiplier, FIG. 6(A) being a diagram for describing a procedure of determining the threshold value in terms of a distribution of pulse height and FIG. 6(B) being a diagram for describing a procedure of taking out only a light pulse current from the output signal of the photomultiplier based on the threshold value;

FIG. 7 shows photon counting data obtained using the conventional photomultiplier shown in FIG. 1;

FIG. 8 shows the distribution of energy of secondary electrons emitted from the first dynode of the photomultiplier;

FIGS. 9(A), 9(B) and 9(C) show photon counting data on secondary electrons having the regions a, b and c of the distribution of energy;

FIG. 10 is a diagram for describing the orbits of elastically reflected electrons;

FIG. 11 shows a schematic view of a photomultiplier according to the present invention;

FIGS. 12(A), 12(B) and 12(C) show enlarged perspective views of shield electrodes for the photomultiplier as shown in FIG. 11;

FIG. 13 shows photon counting data obtained by the photomultiplier as shown in FIG. 11; and FIGS. 14 and 15 show partial views of modifications of the photomultiplier as shown in FIG. 11.

DETAILED DESCRIPTION OF THE INVENTION

An embodiment of the present invention is hereafter described with reference to the accompanying drawings.

FIG. 11 shows a photomultiplier according to this invention. FIG. 12 (A) shows an enlarged perspective view of a shield electrode 26 as shown in FIG. 11, and FIGS. 12(b) and 12(c) show enlarged perspective views of modifications of the shield electrode as shown in FIG. 12(A). The mutually corresponding components as shown in FIGS. 11 and 1 are represented by the same references.

The photomultiplier 1 according to this invention as shown in FIG. 11 includes a focusing electrode 25, the shield electrode 26, a flat plate electrode 6 and an electric insulator 31 on the flat plate electrode 6, which are provided between the photocathode 4 and a first dynode 7.

The focusing electrode 25 functions in the same manner as the first focusing electrode 52 as shown in FIG. 1, so that photoelectrons primary electrons emitted from the photocathode 4 when light impinges on the photocathode are converged toward the first dynode 7. The bottom 39 of the focusing electrode 25 is provided with an opening 30 in which the shield electrode 26 is inserted. The focusing electrode 25 is located at predetermined distances from the electric insulator 31 and the flat plate electrode 6 by stem pins 32.

The shield electrode 26 is provided so that elastically reflected electrons from the first dynode 7 are prevented from impinging on the first dynode again. As shown in FIG. 12(A), the shield electrode 26 comprises a top 34 having an upper opening 28, a side portion 35 partially shaped as a truncated cone, and a bottom 36 having a lower opening 29. Each of the top 34 and bottom 36 of the shield electrode 26 is in the form of a disk. The upper and the lower openings 28 and 29 are concentric to the top 34 and the bottom 36 respectively. The shield electrode 26 is located in such a position that the primary electrons emitted from the photocathode 4 surely pass through the upper opening 28 of the shield electrode toward the first dynode 7 and secondary electrons elastically reflected from the first dynode do not return to the photocathode through the upper opening 28 but are captured by the inside surface of the shield electrode. As shown in FIG. 11, the top 34 of the shield electrode 26 is located closer to the photocathode 4 than to the first dynode 7. In order to allow the primary electrons from the photocathode 4 to surely pass through the upper opening 28 of the top 34 of the shield electrode 26, the upper opening should preferably be located in a position where the cross section of the orbit of the primary electrons converged by the focusing electrode 25 is most constricted. For that purpose, the lower edge of the truncated-cone-shaped part of the side portion 35 of the shield electrode 26 is located in nearly the same plane as the bottom 39 of the focusing electrode 25, and the top 34 of the shield electrode is located below the upper edge of the side portion 38 of the focusing electrode 25. In order to place the shield electrode 26 in the above-described manner, the axial length of the side portion 38 of the focusing electrode 25 is made longer than that of the truncated-cone-shaped part of the side portion 35 of the shield electrode 26.

The diameter D1 of the upper opening 28 of the shield electrode 26 is set so as to limit the effective area of the light incidence portion of the photocathode 4. If the diameter D1 of the upper opening 28 is smaller, the elastically reflected electrons return to the photocathode with a smaller probability, and at the same time the photoelectrons emitted from the photocathode 4 when the light impinges on the photocathode reach the first dynode 7 with a smaller probability, so that it is impossible to measure a main pulse current accurately or with high sensitivity. If the diameter D1 of the upper opening 28 is larger, the photoelectrons emitted from the photocathode 4 impinge on the first dynode 7 with a higher probability to increase the main pulse current, and at the same time the elastically reflected electrons from the first dynode 7 return to the photocathode with a higher probability to increase a residual pulse current, so that it is impossible to detect only the main pulse current accurately. Accordingly, the diameter D1 of the upper opening 28 is designed such that the passage of the photoelectrons emitted from the photocathode 4 is not so much hindered and the return of the elastically reflected electrons to the vicinity of the photocathode is effectively suppressed. When the diameter of the actual light incidence portion of the photocathode 4 for the effective area of the portion is set at about 5 mm, for example, the diameter D1 of the upper opening 28 is set at 77 to 67% of the diameter of the actual light incidence portion of the photocathode for the effective area of the portion or set at about 3.5 mm.

The diameter D3 of the lower opening 29 of the shield electrode 26 is set such that the photoelectrons having passed through the upper opening 28 are not prevented from impinging on the first dynode 7. For example, the diameter D3 of the lower opening 29 is set so that the periphery of the lower opening is located on an imaginary truncated-cone-shaped surface extending from the periphery of the upper opening 28 to that of the opening 24 of the flat plate electrode 6. In that case, the diameter D3 of the lower opening 29 is set at about 8 mm.

The diameters D2 and D4 of the top 34 and bottom 36 of the shield electrode 26 as shown in FIG. 12(A) are set at about 7 mm and about 31 mm, respectively. The height H1 of the truncated-cone-shaped part of the side portion 35 of the shield electrode 26 is set at about 21.35 mm.

Each of shield electrode 71 and 73 as shown in FIGS. 12(B) and 12(C) may be provided instead of the shield electrode 26 as shown in FIG. 12(A). The shield electrode 71 as shown in FIG. 12(B) is in a disk form and has an opening 72 at the center thereof. The shield electrode 73 as shown in FIG. 12(C) is in the form of a truncated cone and has openings defining the top 74 and bottom 75 thereof. As well as the shield electrode 26 shown in FIG. 12(A), the shield electrodes 71 and 73 as shown in FIGS. 12(B) and 12(C) are located in such a position that the primary electrons emitted from the photocathode 4 surely pass through the shield electrode toward the first dynode 7 and the secondary electrons elastically reflected from the first dynode do not return to the photocathode. For that purpose, each of the shield electrode 71 and the top 74 of the shield electrode 73 is located closer to the photocathode 4 than to the first dynode 7. The present invention is not limited to the shapes of the shield electrodes 26, 71 and 73 as shown in FIGS. 12(A), 12(B) and 12(C), but may be embodied using other shield electrodes having different shapes.

The shield electrodes 26, 71 and 73 as shown in FIGS. 12(A), 12(B) and 12(C) are preferably made of a metal, and more preferably made of such a metal having large work function as tin and copper. Further it is preferable that the inside surface of each of the shield electrodes 26, 71 and 73 is not mirror-polished, but made porous in order to efficiently capture the secondary electrons reflected from the first dynode 7.

Each of the shield electrodes 26, 71 and 73, as well as the focusing electrode 25, is located at predetermined distances from the electric insulator 31 and the flat plate electrode 6 by stem pins 33.

The flat plate electrode 6 supports the focusing electrode 25 and the shield electrode 26, 71 or 73 with the stem pins 32 and 33 and electrically separates the photocathode 4 form the first dynode 7 to twelfth dynode 18 and an anode 19.

Figure 2:
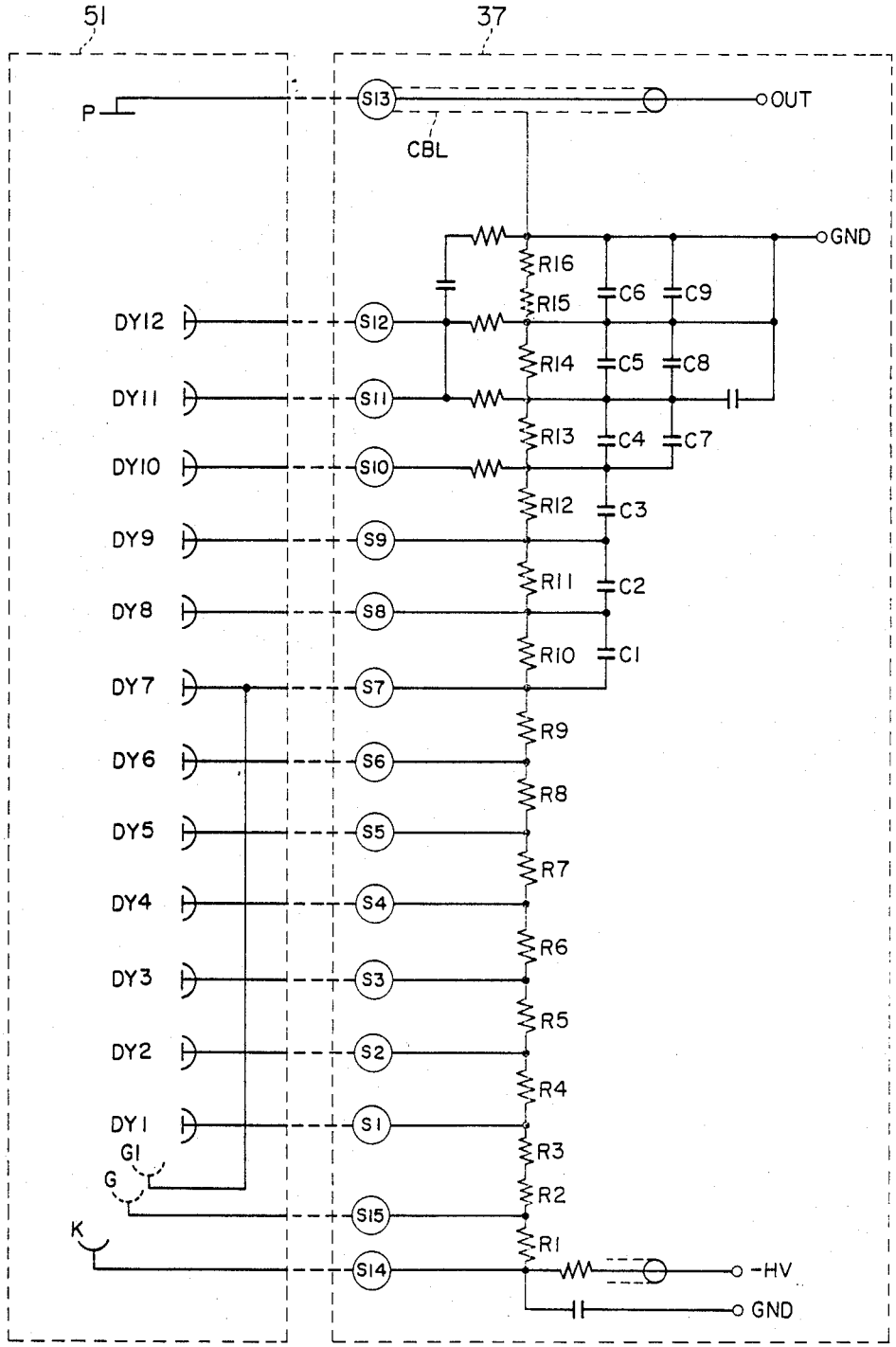
FIG. 2 shows the state of connection of the photomultiplier and an external circuit.

The photocathode 4, the focusing electrode 25, the dynodes 7 to 18 and the anode 19 are connected to corresponding connection pins K, G, DY1, DY2, DY3, DY4 DY5, DY6, DY7, DY8, DY9, DY10, DY11, DY12 and P through the stem pins 32 and 33 and lead wires not shown in the drawings. Each of the shield electrodes 26, 71 and 73 is connected to a connection pin G1 which is connected to the seventh dynode 13, for example. The flat plate electrode 6 is connected to the connection pin DY1 for the first dynode 7. Potentials as shown in Table 1 are applied to the electrodes of the photomultiplier 1 from an external circuit which is entirely the same as the external circuit 37 as shown in FIG. 2. The potential of −2,500 V is applied to the photocathode 4. The anode 19 is kept at the ground potential. Each of the shield electrodes 26, 71 and 73 is kept at the same potential of −1,200 V as the seventh dynode 13. As the potential on each of the shield electrodes 26, 71 and 73 is higher than that on the photocathode 4, the electric field intensity near the photocathode 4 is heightened. Table 1 shows the concrete values of the voltages applied to the electrode of the photomultiplier 1 and those of the potentials of the electrodes of the photomultiplier based on the photocathode. The state of the connection of the connection pins K, G, G1, DY1 to DY12, P and the external circuit is the same as that shown in FIG. 2.

When the photomultiplier 1 as described above is used in the apparatus as shown in FIG. 4 to count photons instead for the conventional photomultiplier 51 (in order to simplify the descriptions, it is supposed that the shield electrode 26 shown in FIG. 12(A) is provided in the photomultiplier), the weak light such as fluorescent light, which is in the SPE state, is irradiated upon the photocathode 4 of the photomultiplier 1 by the pulse generator 62, the optical fiber 63 and the filter 64. As a result, the photoelectrons or primary electrons are emitted from the photocathode 4, and converged by the focusing electrode 25 to accurately enter the upper opening 28 of the top 34 of the shield electrode 26 and impinge on the secondary electron emission surface 22 of the first dynode 7 through the upper opening, the lower opening 29 of the bottom 36 of the shield electrode and the opening 24 of the flat plate electrode 6. At that time, secondary electrons are emitted from the secondary electron emission surface 22 of the first dynode 7.

Among the secondary electrons, those which are ordinary secondary electrons in the region a of the energy distribution as shown in FIG. 8 directly proceed to the second dynode 8 to be multiplied by the second dynode 8 to twelfth dynode 18 so that a main pulse current $MP_2$ which is the same as that shown in FIG. 9(A) is outputted form the anode 19.

Further, some of the secondary electrons in the region b of the energy distribution as shown in FIG. 8 directly proceed to the second dynode 8 so that a main pulse current which is the same as that shown in FIG. 9(B) is outputted from the anode 19. The others of the secondary electrons in region b of the energy distribution shown in FIG. 8, that is, backscattered electrons proceed toward the photocathode and are reflected or absorbed by the bottom 36 of the shield electrode 26 as shown by orbits L4 and L5 in FIG. 11, or are reflected or absorbed by the inside surface of the shield electrode 26 to be captured by the shield electrode even though having passed through the lower opening 29 of the shield electrode as shown by orbits L1 and L2 in FIG. 11. Even if the backscattered electrons return to the first dynode 7, a residual pulse current resulting from the backscattered electrons is not practically measured as described above.

Among the secondary electrons, elastically reflected electrons tend to return to the vicinity of the photocathode 4 but are reflected or absorbed by the bottom 36 of the shield electrode 26 as shown by the orbits L4 and L5 as well as the backscattered electrons, not to return to the first dynode 7, or the elastically reflected electrons pass through the lower opening 29 of the shield electrode as shown by the orbits L1 and L2 in FIG. 11 and are thereafter reflected or absorbed by the inside surface of the shield electrode 26 not to reach the first dynode 7 again. Even if the elastically reflected electrons pass through the lower and upper openings 29 and 28 of the shield electrode 26 and return to the vicinity of the photocathode as shown by an orbit L3 in FIG. 11, the electrons cannot reach the first dynode 7 through the upper opening 28 of the shield electrode 26 again.

If the elastically reflected electrons reach the first dynode 7 again, a residual pulse current $AP_2$ would be outputted from the anode 19 as shown in FIG. 9(C). However, in this invention, the shield electrode reflects or absorbs the elastically reflected electrons to capture them, or to make it impossible for the elastically reflected electrons to reach the first dynode 7 again even though returning to the vicinity of the photocathode 4, so that the probability that the residual pulse current $AP_2$ is outputted from the anode 19 is very low.

Since the potential on the shield electrode 26 is kept higher than that on the photocathode 4, the probability that the secondary electrons are absorbed by the shield electrode is heightened.

The output pulse signal from the photomultiplier 1, which is the pulse current, is amplified by the amplifier 65 and then supplied to the constant fraction discriminator 66 which removes the pulse current of a noise such as a dark current based on a predetermined theshold value LLD to detect only a light pulse current, as described above. When the pulse current not lower than the threshold value LLD is outputted from the photomultiplier 1, the constant fraction discriminator 66 supplies the stop siganl STOP to the time-to-amplitude converter 60 and then the converter measures the time tt from the generation of the start signal STT to that of the stop signal and supplies the measured time to the computer 58 through the multichannel analyzer 59. The frequency $\alpha$ of single photon for the time tt is accumulated as photon counting data in the computer 58, so that when a piece of data, that is, the time tt is supplied from the time-to-amplitude converter 60 to the computer, the frequency of single photon for the time tt is increased by one.

The single photon SP is repeatedly irradiated upon the photomultiplier 1. At every time of the irradiation, the time tt which elapses from the generation of the start signal STT to that of the stop signal STOP is measured, and the frequency $\alpha$ of single photon for the time tt is determined by the computer 58 and outputted to the plotter 47.

FIG. 13 shows the result of the measurement of the output from the photomultiplier 1. It is apparent from FIG. 4 that the full width at half-maximum FWHM2 of the frequency of single photon for the main pulse current $MP_2$ is about 200 to 300 picoseconds. The residual pulse current $AP_2$ is detected with its generation probability of 0.13%, in about 8 to 10 nanoseconds after the main pulse current $MP_2$ is detected. By comparing the result of the measurement of the output from the photomultiplier 1 as shown in FIG. 13 with that of the measurement of the output from the conventional photomultiplier 51 as shown in FIG. 7, it is found out that the full width at half-maximum FWHM2 of the frequency of single photon for the main pulse current $MP_2$ from the photomultiplier 1 is about a half of that FWHM1 of the frequency of single photon for the main pulse current $MP_1$ from the conventional photomultiplier 51, and the detected time from the generation of the main pulse current $MP_2$ to that of the residual pulse current $AP_2$ is about a half of that from the generation of the main pulse current $MP_1$ to that of the residual pulse current $AP_1$. The probability of the generation of the residual pulse current $AP_2$ is about one-thirtieth of that of the residual pulse current $AP_1$.

The shield electrode 26 having the openings of prescribed sizes according to this invention is provided in such a position in the photomultiplier 1 that the primary electrons emitted from the photocathode 4 and converged by the focusing electrode 25 surely pass through the shield electrode toward the first dynode 7 and the elastically reflected electrons emitted from the first dynode toward the photocathode are captured through reflection or absorption by the shield electrode, so that the probability of the generation of the residual pulse current $AP_2$ is greatly reduced. Further, the potential (which is kept equal to that on the seventh dynode, for example) on the shield electrode 26 is higher than that on the photocathode and therefore the electric field intensity near the photocathode is higher than that in the conventional photomultiplier 51, so that the probability of the absorption of the elastically reflected electrons by the shield electrode 26 is heightened thereby to reduce the probability of the generation of the residual pulse current $AP_2$ further. As the electric field intensity near the photocathode is made higher, the transit time of the electrons from the photocathode to the first dynode 7 is shortened to about 4.5 nanoseconds whereas that of the conventional photomultiplier is about 8 nanoseconds, and therefore the former shortens the transit time of the electrons to nearly a half of the latter. As a result, the detected time from the generation of the main pulse current $MP_2$ to that of the residual pulse current $AP_2$ is nearly reduced to a half of that of the conventional photomultiplier 51. Further, the fluctuation of the main pulse current $MP_2$ with time is reduced so that the full width at half-maximum FWHM2 of the frequency of single photon for the main pulse current is decreased to about a half of that of the conventional photomultiplier 51.

In FIG. 13, the time convolution of the time characteristic or fluorescent light damping curve $CV_o(t')$ (as shown in FIG. 3(B)) of actual fluorescent light and the time fluctuation curve $h(t'-t)$ of the main and the residual pulse currents $MP_2$ and $AP_2$ which are photon counting data obtained through the use of the photomultiplier 1 is shown in the form of fluorescent light damping data $CV_2(t)$. Since the time fluctuation represented by the time fluctuation curve $h(t'-t)$ and the frequency of single photon for the residual pulse current $AP_2$ are reduced in the photomultiplier 1, the fluorescent light damping data $CV_2(t)$ are closer to the actual fluorescent light damping curve $CV_o(t)$ as shown in FIG. 3(B) than the fluorescent light damping curve $CV_1(t)$ shown in FIG. 7.

According to the shield electrode 26 of this invention, the generation of the residual pulse current $AP_2$ is effectively suppressed. Further, as the potential on the shield electrode 26 is higher than that on the photocathode 4, the generation of the residual pulse current $AP_2$ is more effectively suppressed and the time fluctuation of the main pulse current $MP_2$ is effectively suppressed. As a result, the time point of generation of single photon SP as shown in FIG. 3(C) can be detected with high accuracy. Still further, when the photomultiplier 1 is used to measure the actual fluorescent light from a sample, the fluorescent light damping curve $CV_o(t)$ as shown in FIG. 3(B) can be accurately detected and therefore accurately measure the life of the fluorescent light.

FIGS. 14 and 15 show partial views of photomultipliers 40 and 44 which are modifications of the photomultiplier 1.

In the photomultiplier 40 as shown in FIG. 14, a focusing electrode 41 is provided instead of the focusing electrode 25 of the photomultiplier 1 as shown in FIG. 11. The axial length of the side portion 42 of the focusing electrode 41 is shorter than that of the side portion of the focusing electrode 25. The bottom 43 of the focusing electrode 42 is located in nearly the same plane as the top 34 of the shield electrode 26. The same potential of −2,360 V as that on the focusing electrode 25 is applied to the focusing electrode 41.

In the photomultiplier 40 as shown in FIG. 14, photoelectrons or primary electrons emitted from the photocathode are converged toward the center line of the photomultiplier by the focusing electrode 41 so that the cross section of the orbit of the electrons is more constricted than that in the photomultiplier 1 as shown in FIG. 11. Therefore, the primary electrons emitted from the photocathode 4 of the photomultiplier 40 are caused to more accurately proceed to the first dynode 7 through the upper opening 28 of the shield electrode 26 and the diameter of the effective area of the photocathode 4, which is 5 mm in the photomultiplier 1, can be increased to about 7 mm to produce the output signal with higher sensitivity.

In the photomultiplier 44 as shown in FIG. 15, a light-incident plate 45 and a photocathode 46, which differ in form from the light-incident plate 3 and photocathode 4 of the photomultiplier 1 as shown in FIG. 11, are provided. The light-incident plate 45 differs in the form of the inside curved surface from the light-incident plate 3 and is larger in the curvature of the inside curved surface than the light-incident plate 3. The radius of curvature of the inside surface of the light-incident plate 3 is 55 mm, while that of curvature of the inside surface of the light-incident plate 45 is 25 mm. Therefore, the curvature of the inside surface of the light-incident plate 45 is about twice as much as that of the inside surface of the light-incident plate 3. The radius of curvature of the photocathode 46 provided along the inside curved surface of the light-incident plate 45 is set at 25 mm. As a result, the curvature of the photocathode 46 is about twice as much as that of the photocathode 4. Since the curvature of the photocathode 46 is made larger, the cross section of the orbit of photoelectrons or primary electrons emitted from the photocathode is more constricted toward the center line of the photomultiplier 44 to accurately guide the electrons to the upper opening 28 of the shield electrode 26. As a result, the effective area of the photocathode 46 can be increased to produce the output signal with higher sensitivity.

When the apparatus as shown in FIG. 4 is used for each of the photomultipliers 40 and 44 as shown in FIGS. 14 and 15, to perform measurement, photon counting data are obtained with a low probability of generation of a residual pulse current and a small time fluctuation as well as the photomultiplier 1 as shown in FIG. 11.

According to the present invention, a shield electrode having an opening of prescribed size is positioned between a photocathode and a dynode to direct primary electrons from the photocathode to the dynode and capture secondary electrons emitted from the dynode toward the photocathode, so that the probabiltiy of the generation of a residual pulse current is greatly reduced and the accuracy of analysis of photon counting data can be very much heightened.

TABLE 1

| Electrode | | Applied Voltage (V) | Applied Voltage (V) |
|---|---|---|---|
| Photocathode | 4 | −2,500 | 0 |
| Focusing electrode | 25 | −2,360 | 139.5 |
| Shield electrode | 26 | −1,220 | 1,279.1 |
| Flat plate electrode | 6 | −2,035 | 465.1 |
| First dynode | 7 | −2,035 | 465.1 |
| Second dynode | 8 | −1,895 | 604.6 |
| Third dynode | 9 | −1,687 | 813.9 |
| Fourth dynode | 10 | −1,570 | 930.2 |
| Fifth dynode | 11 | −1,453 | 1,046.5 |
| Sixth dynode | 12 | −1,337 | 1,162.7 |
| Seventh dynode | 13 | −1,220 | 1,279.1 |
| Eight dynode | 14 | −1,105 | 1,395.3 |
| Ninth dynode | 15 | −990 | 1,511.6 |
| Tenth dynode | 16 | −815 | 1,686.0 |
| Eleventh dynode | 17 | −640 | 1,860.5 |
| Twelfth dynode | 18 | −290 | 2,209.3 |
| Anode | 19 | 0 | 2,500.0 |

What is claimed is

1. A photomultiplier comprising;

photoelectric conversion means for emitting primary electrons in response to an incident light;

electron-multiplication means for emitting secondary electrons in response to incidence of said primary electrons thereto and multiplying first secondary electrons passing therein to output an electrical signal corresponding to said multiplied secondary signals;

focusing means for converging said primary electrons into said electron-multiplication means;

separating means for electrically separating said photoelectric conversion means from said electro-multiplication means; and shield means for preventing second secondary electrons emitted from said electron-multiplication means toward said photoelectric conversion means and reflected therefrom from returning to said electron-multiplication means, said shield means being located between said photoelectric conversion means and said electron-multiplication means.

2. A photomultiplier as claimed in claim 1, wherein said electron-multiplication means comprises plural dynodes for multiplying said first secondary electrons and an anode for outputting said electrical signal.

3. A photomultiplier as claimed in claim 1, wherein said shield means comprises a shielding member for reflecting or capturing said second secondary electrons and at least one opening formed in said shielding member for passing said primary electrons therethrough to said electron-multiplication means.

4. A photomultiplier as claimed in claim 1, wherein an insulator is provided between said shield means and said separating means.

5. A photomultiplier as claimed in claim 1, wherein the bottom of said focusing means is located in the substantially same plane as the top of said shield means.

6. A photomultiplier as claimed in claim 1, wherein said photoelectric conversion means has a radius of curvature necessary for converging said primary electrons into said electro-multiplication means.

7. A photomultiplier as claimed in claim 3, wherein said shield means is located in such a position that the top of said shield means is closer to said photoelectric conversion means than to said electro-multiplication means.

8. A photomultiplier as claimed in claim 3, wherein said shielding member is a disk.

9. A photomultiplier as claimed in claim 3, wherein said shielding member is in the form of a truncated cone.

10. A photomultiplier as claimed in claim 3, wherein said shielding member comprises a first member in the form of a truncated cone and a second member in the form of a cylinder.

11. A photomultiplier comprising;

photoelectric conversion means for emitting primary electrons in response to an incidence light;

electron-multiplication means for emitting secondary electrons in response to incidence of said primary electrons thereto and multiplying first secondary electrons passing therein to output an electrical signal corresponding to said multiplied secondary signals; and shield means for preventing second secondary electrons emitted from said electron-multiplication means toward said photoelectric conversion means and reflected therefrom from returning to said electron-multiplication means, said shield means being located between said photoelectric conversion means and said electron-multiplication means.

* * * * *